US005156454A

United States Patent [19]

White

[11] Patent Number: 5,156,454

[45] Date of Patent: Oct. 20, 1992

[54] IN GROUND RECESSED OR PROJECTING YARD LIGHT

[76] Inventor: Daniel White, 81-541 Rosemary Ct., Indio, Calif. 92201

[21] Appl. No.: 738,609

[22] Filed: Jul. 31, 1991

[51] Int. Cl.[5] ..... F21V 17/4

[52] U.S. Cl. ..... 362/153; 362/153.1; 362/364; 362/365

[58] Field of Search ..... 362/153, 153.1, 364, 362/365, 310, 202, 290

[56] References Cited

U.S. PATENT DOCUMENTS

| | | | |
|---|---|---|---|
| 1,686,363 | 10/1928 | Baldwin . | |
| 2,504,327 | 4/1950 | Gross | 362/365 |
| 2,920,188 | 1/1960 | Clayton et al. | 362/365 |
| 3,007,034 | 10/1961 | Reed et al. . | |
| 3,300,634 | 1/1967 | Liberman | 362/365 |
| 3,446,955 | 5/1969 | Bailey et al. | 362/290 |
| 3,962,675 | 1/1976 | Rowley et al. | 362/365 |
| 4,180,850 | 12/1979 | Bivens . | |
| 4,314,320 | 2/1982 | Wolar | 362/290 |
| 4,523,263 | 6/1985 | Poyer | 362/267 |
| 4,535,397 | 8/1985 | May | 362/369 |
| 4,667,278 | 5/1987 | Poyer | 362/365 |
| 4,695,930 | 9/1987 | Wierzbicki et al. | 362/293 |
| 4,984,139 | 1/1991 | Goggia . | |
| 4,999,757 | 3/1991 | Poppenheimer | 362/365 |
| 4,999,758 | 3/1991 | Wimberly . | |

FOREIGN PATENT DOCUMENTS

| | | | |
|---|---|---|---|
| 1936925 | 1/1970 | Fed. Rep. of Germany | 362/364 |

*Primary Examiner*—Ira S. Lazarus
*Assistant Examiner*—Leonard Heyman
*Attorney, Agent, or Firm*—Dennison, Meserole, Pollack & Scheiner

[57] ABSTRACT

A yard light having a cylindrical housing with a cap telescoped over the upper end portion thereof. The cap internally receives a bulb seated on a shoulder within the cap. The bulb is retained against the shoulder by an annular retaining ring for removal from the housing as a unit with the cap or independently thereof.

7 Claims, 2 Drawing Sheets

IN GROUND RECESSED OR PROJECTING YARD LIGHT

BACKGROUND OF THE INVENTION

The present invention is concerned with lighting fixtures of the type associated with ground level illumination for decorative yard and landscape lighting, area definition such as along walkways, general illumination for safety purposes, and the like.

While fixtures for such general purposes are commonly used, the positioning of such fixtures as ground-mounted units make them particularly susceptible tc damage, either accidental as during lawn care, or intentional.

Problems also arise with regard to providing protective enclosures to the relatively vulnerable light bulbs. An associated problem encountered with known landscape lighting fixtures is the difficulty in accessing the bulbs for replacement.

SUMMARY OF THE INVENTION

An object of the present invention is to provide yard lights or lighting fixtures formed of a combination of simple and durable components which are inexpensive in and of themselves and lend themselves to convenient assembly into the finished units. The lighting fixtures formed in this manner are economically practical and particularly adapted for installation and maintenance by the individual homeowner.

It is also significant that the yard light of the invention be a structurally stable unit capable of withstanding the type of abuse which might be anticipated in a ground fixture exposed to weather elements, contact with gardening implements, and the like.

A further object of the invention is the provision of a yard light wherein there is little or no possibility of a deterioration or malfunctioning thereof, notwithstanding intimate engagement with the ground, in light of the nature of the materials used and the manner in which the components are assembled into a rigid unitary structure.

Basically, the yard light includes a vertically elongate hollow cylindrical housing receiving a hollow cylindrical cap over the open upper end of the housing. The cap frictionally engages the housing and positively mounts thereto in a manner requiring a specific manual force for removal of the cap. The cap, at approximately mid-height therein, includes a downwardly directed shoulder against which the flange of a bulb upwardly seats. The bulb is retained against the shoulder by a circular retaining ring which frictionally engages against the inner surface of the cap below the shoulder and immediately underlying the flange of the bulb. So mounted, removal of the cap from the housing also lifts out the bulb, exposing the wiring for bulb replacement.

A protective slightly domed lens is positioned over and sealed to the upper end of the cap in vertically spaced relation above the bulb for a protective enclosure thereof. The light will normally be embedded in the ground with the lens at ground level so as not to interfere with gardening equipment, thus making the light particularly adapted for installation within lawns. The domed configuration of the lens provides a self-cleaning feature with the debris tending to move to the sides of the lens. The lower end of the housing is preferably open to avoid any moisture accumulation, and includes lateral openings therethrough for introduction of the appropriate power lines or electrical conductors.

In a variation of the yard light, the cap includes an upwardly directed shoulder which receives and seats the bulb flange thereon. The bulb flange is overlaid by a retaining ring frictionally engaged with the cylindrical inner surface of the cap engaged against the upper surface of the bulb flange.

A light diffusing circular grid mounts within the open upper end of the cap and is removably retained by screws for selective removal to allow access to the retaining ring and bulb for bulb replacement without removal of the cap. Such an arrangement will be particularly desirable in those circumstances wherein the yard light is to be elevated above ground level in that, by providing a removable protective and light diffusing grid, the cap can be permanently or semi-permanently fixed to the housing to avoid accidental disengagement.

Other features and advantages of the invention will become apparent from the more detailed description of the invention following hereinafter.

DESCRIPTION OF PREFERRED EMBODIMENTS

Figure 1:
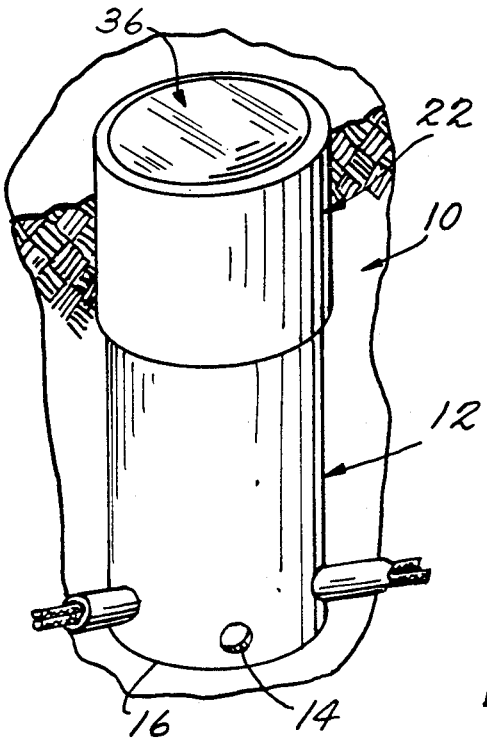
FIG. 1 is a perspective view of the Yard light of the present invention embedded within the ground with the upper end thereof at ground level.
Figure 2:
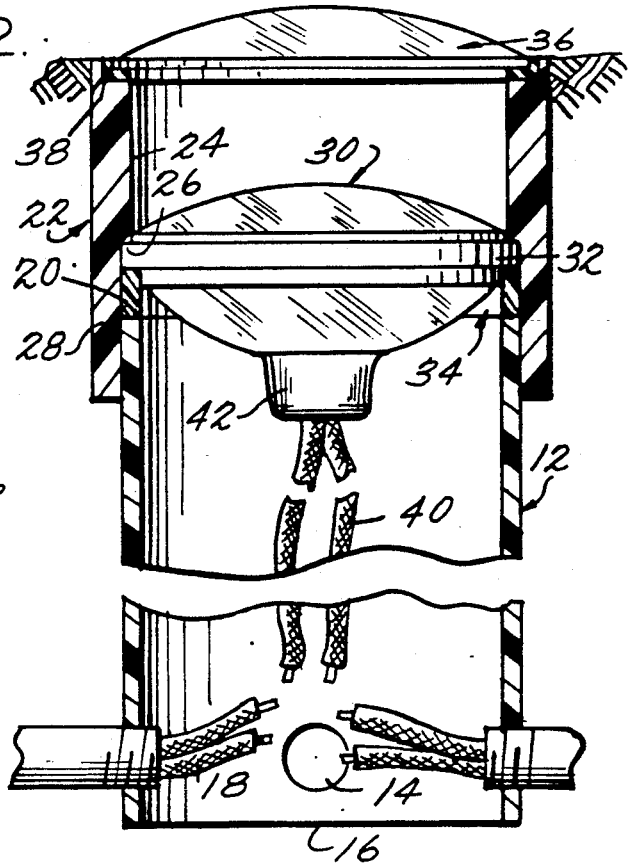
FIG. 2 is an enlarged vertical cross-sectional view through the yard light.

The yard light 10 of the invention includes a tubular, and preferably cylindrical, vertically elongate housing 12 formed of a high impact rigid synthetic resin. As an example, the housing can comprise a length of conventional 4" ABS pipe which is both readily and inexpensively available. The pipe, in order to define the housing 12, a major component of the yard light 10, need only be provided with holes 14 laterally therethrough and preferably adjacent the open lower end 16 for the accommodation of appropriate underground cabling or electrical conductors 18. The upper end of the housing 12, defined by an upwardly directed peripheral edge 20, is also open.

The vertically elongate tubular or cylindrical cap 22, of an appropriate rigid resin such as polyvinychloride (PVC) includes an internal surface 24 with a downwardly directed, annular seat forming shoulder 26 defined therein at approximately mid-height of the cap 22. The cap 22, below the annular shoulder 26, defines a skirt portion 28 which telescopically receives the open upper end portion of the housing 12 therein with the frictional engagement therebetween forming a positive peripheral seal and requiring specific manual pressure for disengagement. The hollow interiors of the housing and cap, when assembled, define an interior chamber.

The bulb 30 which provides the illumination is of a standard construction, sealed for outdoor use and including a peripheral flange 32 which seats upwardly against the internal cap shoulder 26.

The bulb is releasably retained snugly against the shoulder 26 and within the chamber by a retaining ring 34. The ring 34 is of an appropriate synthetic resinous material such as PVC possessing sufficient rigidity, along with a degree of resiliency, as to frictionally engage with the interior surface of the skirt portion 28 of the cap 22 in supporting engagement with the bulb for a positive retention of the bulb against the shoulder 26 until such time as the retaining ring 34 is forcibly removed. As will be appreciated from the drawings, the height of the retaining ring 34 is substantially less than that of the skirt portion 28 whereby a major portion of the skirt portion is provided below the retaining ring 34 for frictional engagement with the upper portion of the housing 12 telescopically received therein.

It will also be noted that with the light assembled, the upper peripheral edge 20 of the housing 12 engages against the lower edge of the retaining ring 34, thus further stabilizing the retaining ring, defining the downward limit of the cap 22 and enhancing the rigidity of the entire assembly.

In order to enclose and protect the bulb 30, an appropriate shatter-proof lens 36 overlies the open upper end of the cap 22 and is permanently mounted and peripherally sealed thereto as at 38. It is contemplated that the lens be slightly upwardly domed so as to be self-cleaning with any debris, such as grass clipping or the like, falling thereon tending to slide off to the sides of the lens and away from the light. Notwithstanding the domed configuration, the lens is to be low profile in that the yard light 10 will normally be buried in the ground with the upper end of the cap 22 and lens 36 at ground level so as to not interfere with lawn equipment such as lawn mowers, rakes and the like.

Figure 3:
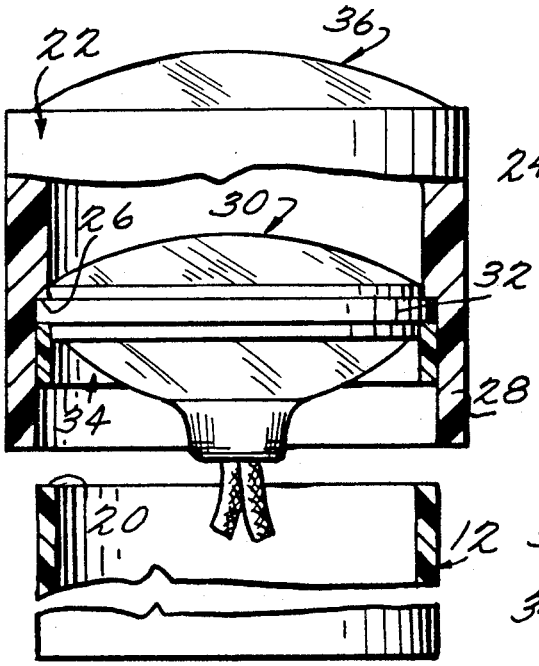
FIG. 3 is a vertical cross-sectional detail illustrating the cap and bulb removed as a unit from the housing.
Figure 4:
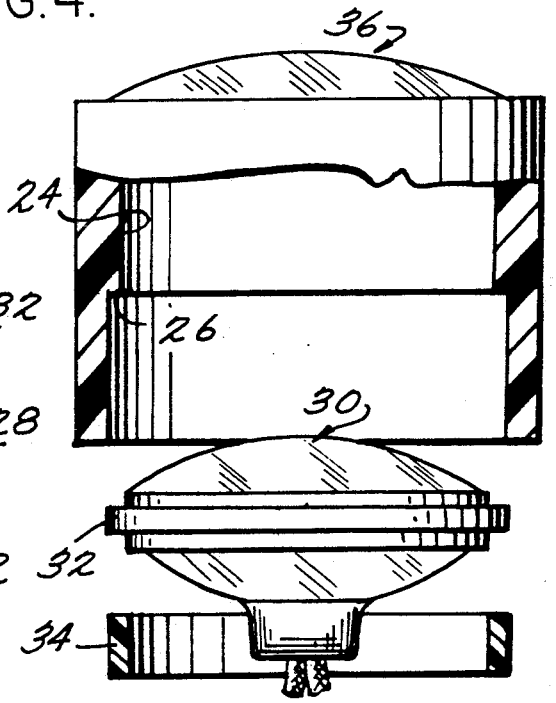
FIG. 4 is an exploded perspective view of the cap, bulb and retaining ring.

Noting FIG. 3 in particular, should it become necessary to change the bulb 30, the cap 22 will be manually grasped and vertically removed from the housing 12. The bulb 30, retained within the cap by the retaining ring 34, will be removed from the housing with the cap. As will be appreciated, the bulb 30 will have appropriate electrical wiring 40 electrically connected and sealed thereto, as at 42. The electrical wiring 40, through appropriate wire connector elements, such as wire nuts (not illustrated), will be connected in circuit to the underground cabling 18. Sufficient slack will be provided in the wiring and/or cabling to allow for a retraction of the bulb 30, upon a removal of the cap 28, to expose the connections for a release of the bulb 30 from the circuit.

After a removal of the cap 22 with the mounted bulb 30, the retaining ring 34 is withdrawn and the bulb removed from the bottom of the cap. A replacement bulb can then be inserted, the retaining ring 34 repositioned to fix the bulb against the inner cap shoulder 26, the wiring reengaged, and the cap and bulb assembly frictionally engaged over the upper end portion of the housing 12.

Figure 5:
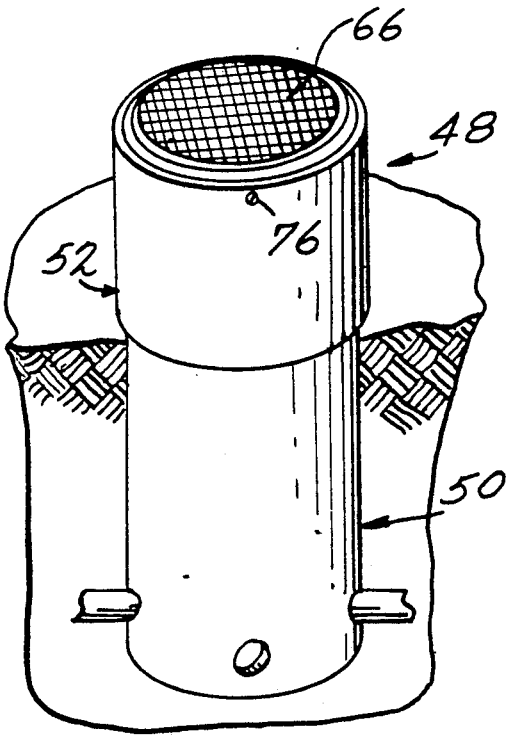
FIG. 5 is a perspective view of a variation of the yard light mounted in position within the ground and vertically projecting thereabove.
Figure 6:
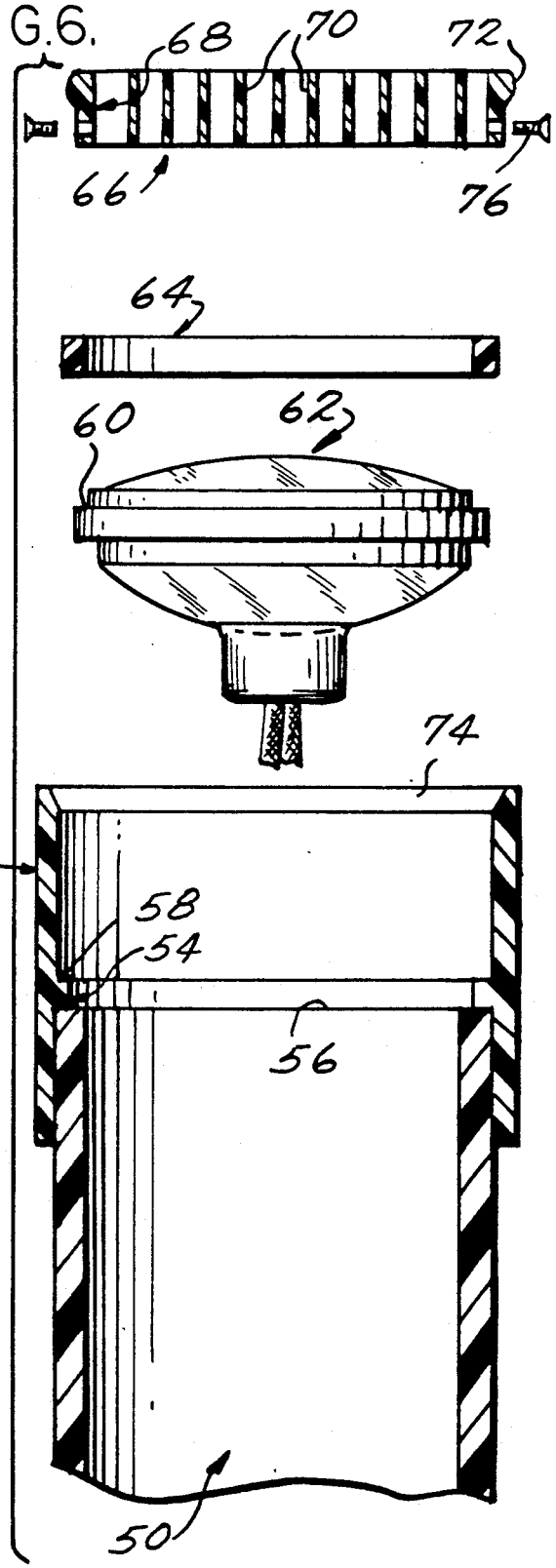
FIG. 6 is an exploded perspective view of the components of the Yard light of FIG. 5.
Figure 7:
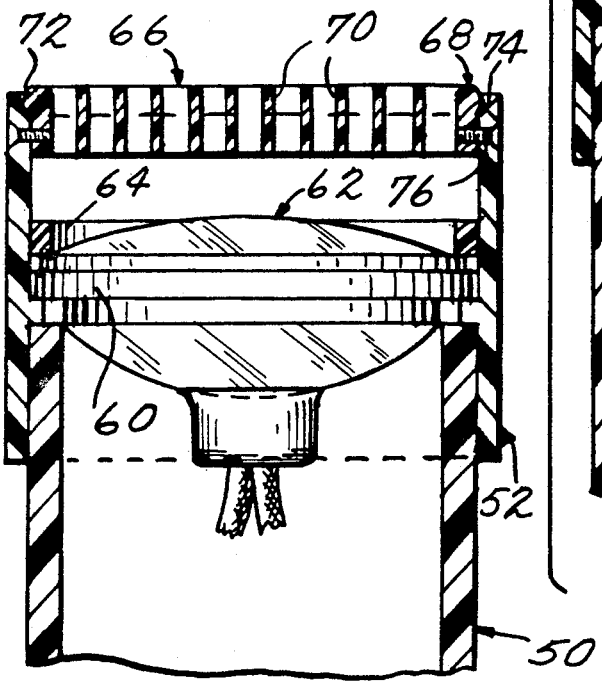
FIG. 7 is a vertical cross-sectional view through the upper portion of the yard light of FIG. 5.

Referring now to FIGS. 5–7, the modified form of yard light 48 illustrated therein is more particularly adapted to partially project above the ground level for use in flower beds, ground cover and the like where the growth requires an elevated positioning of the light to avoid excess blockage thereof.

The yard light 48 includes a vertically elongate cylindrical housing 50, substantially the same as housing 12 and similarly formed of a high impact synthetic resin, preferably a length of 4" ABS pipe.

A cylindrical cap 52, also of an appropriate synthetic resin, is of a size so as to closely receive the upper end portion of the housing 50 therein. The cap 52 includes an integral inwardly extending annular rib 54 at approximately mid-height within the interior thereof, the upper edge 56 of the housing 50 abutting thereagainst upon a full seating of the cap 52 on the housing 50.

The rib 54 defines an upwardly directed support seat or shoulder 58 which receives the peripheral flange 60 of the lamp 62 thereon. The lamp 62 is retained in seated position on the shoulder 58 by means of an annular retaining ring 64 sized and of sufficient yieldability as to frictionally engage with the inner surface of the cap 52 in downwardly pressed engagement with the lamp 62 peripherally thereabout.

The upper end of the cap 52, vertically spaced above the lamp 62, is closed by a circular grid or light diffuser 66 having an annular peripheral flange 68 and an internal grid work of crossing metal bars 70 providing a light-diffusing baffle.

The peripheral flange 68 of the diffuser 66 will be closely received within the open upper end portion of the cap 52, and includes a slightly flared upper end portion 72 thereof which engages the slightly chamfered upper edge 74 of the cap to limit the inward movement of the diffuser and define a positioning means for the diffuser. The diffuser is secured to and within the cap by a series of non-corrosive brass screws or the like 76 thereabout.

It is contemplated that the cap 52, which will be at least partially exposed, be fixed to the telescopically received upper end portion of the housing 50 by means substantially stronger than a manually releasable friction fit. For example, the cap can either be solvent bonded to the housing, or secured thereto by appropriate screws or the like.

Should it be necessary to change the bulb 62, this can be easily effected by a removal of the securing screws 76 and the diffuser grid 66 secured thereby. Direct access to the lamp 62 and retaining ring 64 is then available for replacement of the bulb 62 in the general manner previously described.

As can be appreciated, the cap 52 can be secured to the housing 50 solely by a manually releasably frictional engagement therewith. In such case, the manual removal of the cap 52 will simultaneously remove the bulb from the housing, after which it will still be necessary to remove the diffuser 66 for access to the bulb.

The bulb 62, as with the previously described bulb 30, will be internally wired within the housing to appropriate underground cabling utilizing releasable wire nuts or the like.

As will be appreciated from the foregoing, the yard lighting fixtures above described are uniquely constructed to provide inexpensive and durable assemblies which are easily installed, maintained, and serviced for bulb replacement and the like. The bulb is at all times fully protected, as is the yard light itself when installed as above described.

What is claimed:

1. A yard light for landscape illumination and the like comprising:

a tubular housing, said housing being vertically elongate and including an upper portion with an open upper end; a tubular cap telescopically received about said housing and projecting above said open upper end; said housing and said cap having hollow interiors combining to define an interior chamber, means for removably securing said cap to said housing, a bulb positioned within said chamber and overlying said open upper end of said housing, a downwardly facing shoulder on said cap about said interior thereof, said shoulder defining a seat, within said chamber, said cap extending below said seat and defining a skirt portion, said bulb being positioned within said skirt portion and upwardly seated against said shoulder, a retainer positioned within said skirt portion and upwardly engaged against said bulb and retaining said bulb against said seat, means releasably fixing said retainer in said cap, said skirt portion depending below said retainer and receiving said upper portion of said housing therein, said cap, bulb and retainer being removable from said housing as a unit for replacement of said bulb, and means mounted to said cap in vertically spaced relation over said bulb for protectively enclosing said bulb and controlling light emanating from said bulb.

2. The yard light of claim 1 wherein said housing has an upper peripheral edge about said open upper end, said upper edge engaging upward against said retainer to assist in retention thereof and to define the downward limit of said cap on said housing.

3. The yard light of claim 2 wherein said retainer is an annular member, said means releasably fixing said retainer in said cap comprising a friction interfit of said retainer in said cap.

4. The yard light of claim 3 wherein said means for protectively enclosing said bulb comprises a lens overlying said cap and peripherally sealed thereto, said lens comprising a slightly domed upper surface.

5. A yard light for landscape illumination and the like comprising: a cylindrical housing, said housing being vertically elongate and including an upper portion with an open upper end; a cylindrical cap telescopically received about said housing and projecting above said open upper end; said housing and said cap having hollow interiors combining to define an interior chamber, a bulb positioned within said chamber and overlying said open upper end of said housing, a seat within said chamber, said bulb seating against said seat, a retainer received within said cap, said retainer engaging against said bulb and retaining said bulb against said seat, said retainer comprising an annular member frictionally engaged within said cap.

6. A yard light for landscape illumination and the like comprising: a cylindrical housing, said housing being vertically elongate and including an upper portion with an open upper end; a cylindrical cap telescopically received about said housing and projecting above said open upper end; said housing and said cap having hollow interiors combining to define an interior chamber, a peripheral rib integral with and about said interior of said cap, said rib having an upper surface defining an upwardly facing shoulder and a lower surface against which the telescopically received housing engages for a vertical positioning of said cap relative to said housing, said shoulder defining a seat within said chamber, said cap depending below said seat for telescopic reception of said housing therein, a bulb positioned within said cap overlying the open upper end of said housing and downwardly seated on said shoulder, a retainer positioned within said cap overlying and downwardly engaged against said bulb, means releasably fixing said retainer in said cap for retention of said bulb against said shoulder, said retainer comprising an annular member frictionally engaged within said cap with sufficient force as to require a positive manual release for removal, means mounted to said cap in vertically spaced relation over said bulb for protectively enclosing said bulb and controlling light emanating from said bulb, said means for protectively enclosing said bulb comprising a grid diffuser with a peripheral flange thereabout positioned within said cap, and releasable fastening means securing said flange to said cap for selective access to the interior of said cap and said bulb therein.

7. A yard light for landscape illumination and the like comprising: a cylindrical housing, said housing being vertically elongate and including an upper portion with an open upper end; a cylindrical cap telescopically received about said housing and projecting above said open upper end; said housing and said cap having hollow interiors combining to define an interior chamber, a peripheral rib on and about said interior of said cap, said rib having an upper surface defining an upwardly facing shoulder and a lower surface against which the telescopically received housing engages for a vertical positioning of said cap relative to said housing, said shoulder defining a seat within said chamber, said cap depending below said seat for telescopic reception of said housing therein, a bulb positioned within said cap overlying the open upper end of said housing and downwardly seated on said shoulder, a retainer positioned within said cap overlying and downwardly engaged against said bulb, means releasably fixing said retainer in said cap for retention of said bulb against said shoulder, said retainer comprising an annular member frictionally engaged within said cap with sufficient force as to require a positive manual release for removal.

* * * * *